US010300528B2

(12) United States Patent
Stevick

(10) Patent No.: US 10,300,528 B2
(45) Date of Patent: May 28, 2019

(54) INGOT LOADING MECHANISM FOR INJECTION MOLDING MACHINE

(71) Applicant: Crucible Intellectual Property, LLC, Rancho Santa Margarita, CA (US)

(72) Inventor: Joseph W. Stevick, Olympia, WA (US)

(73) Assignee: CRUCIBLE INTELLECTUAL PROPERTY, LLC, Rancho Santa Margarita, CA (US)

( * ) Notice: Subject to any disclaimer, the term of this patent is extended or adjusted under 35 U.S.C. 154(b) by 0 days.

(21) Appl. No.: 15/452,085

(22) Filed: Mar. 7, 2017

(65) Prior Publication Data

US 2018/0050388 A1 Feb. 22, 2018

Related U.S. Application Data

(63) Continuation of application No. 14/356,745, filed as application No. PCT/US2011/060313 on Nov. 11, 2011, now Pat. No. 9,586,259.

(51) Int. Cl.
*B22D 17/20* (2006.01)
*B22D 17/04* (2006.01)
(Continued)

(52) U.S. Cl.
CPC ..... *B22D 17/20* (2013.01); *B22D 17/04* (2013.01); *B22D 17/14* (2013.01);
(Continued)

(58) Field of Classification Search
CPC ..... B22D 17/20; B22D 17/04; B22D 17/14; B22D 17/2023; B22D 17/2038; B22D 17/28; B22D 18/02
See application file for complete search history.

(56) References Cited

U.S. PATENT DOCUMENTS 5,711,363 A 1/1998 Scruggs et al.
2003/0051851 A1* 3/2003 Yamada ..... B22D 17/007 164/113

FOREIGN PATENT DOCUMENTS

EP 0845316 6/1998
GB 961209 6/1964
(Continued)

OTHER PUBLICATIONS

Japanese Office Action, Japanese Applicaton No. 2014-541021, dated Oct. 7, 2014 (4 pages, including translation).
(Continued)

*Primary Examiner* — Kevin P Kerns
*Assistant Examiner* — Steven S Ha
(74) *Attorney, Agent, or Firm* — Foley & Lardner LLP

(57) ABSTRACT

Disclosed is an apparatus for loading one or more alloy ingots into a molding machine. The apparatus includes a holder configured to hold a plurality of the alloy ingots and dispense one or more of the alloy ingots into a melt zone of the molding machine through an opening in a mold of the machine. The holder is moved in a perpendicular direction with respect to an axis along a center of the opening in the mold between a first position in line with the opening in the mold to dispense one or more of the alloy ingots and a second position away from the opening in the mold. The apparatus can carry ingots of amorphous alloy material so that when the machine melts and molds the material, it forms a bulk amorphous alloy containing part.

26 Claims, 7 Drawing Sheets

(51) Int. Cl.

| | |
|---|---|
| ***B22D 17/14*** | (2006.01) |
| ***B22D 17/28*** | (2006.01) |
| ***B22D 18/02*** | (2006.01) |

(52) U.S. Cl.

CPC ..... *B22D 17/2023* (2013.01); *B22D 17/2038* (2013.01); *B22D 17/28* (2013.01); *B22D 18/02* (2013.01)

(56) References Cited

FOREIGN PATENT DOCUMENTS

| | | |
|---|---|---|
| JP | H01-254364 | 10/1989 |
| JP | H06-034856 | 5/1994 |
| JP | H08-323461 | 12/1996 |
| JP | H09-271930 | 10/1997 |
| JP | H09-323146 | 12/1997 |
| JP | H10-166131 | 6/1998 |
| JP | 2000326065 | 11/2000 |
| JP | 2001-179415 | 7/2001 |
| JP | 2002-224812 | 8/2002 |
| JP | 2004050269 | 2/2004 |
| JP | 2005-324750 | 11/2005 |
| JP | 2006122992 | 5/2006 |

OTHER PUBLICATIONS

International Search Report/Written Opinion, PCT/ISA/210, PCT/ISA/220, PCT/ISA/237, dated Jul. 17, 2012.

* cited by examiner

INGOT LOADING MECHANISM FOR INJECTION MOLDING MACHINE

CROSS REFERENCE TO RELATED APPLICATIONS

This application is a continuation of U.S. patent application Ser. No. 14/356,745, filed May 7, 2014, and entitled "Ingot Loading Mechanism for Injection Molding Machine," which is a 35 U.S.C. § 371 application of PCT/US2011/060313, filed on Nov. 11, 2011, and entitled "Ingot Loading Mechanism for Injection Molding Machine," the contents of which are incorporated by reference as if fully disclosed herein.

FIELD

The present disclosure is generally related to an automated ingot loading mechanism for loading ingots of meltable material into an injection molding system for melting and molding objects therefrom.

BACKGROUND

Some conventional casting or molding machines include a single plunger rod that moves and packs material into a mold using force. In some cases, material to be melted can be provided in pre-molded form, known as an ingot. An ingot can be introduced into a melting zone of a machine via a loading port or a plunger rod. Each time the material is to be melted, an ingot can be loaded manually by an operator. However, it would be beneficial to have a mechanism that is designed to automatically load material for melting (and subsequent molding).

Design of an automated loading mechanism for ingot materials requires unique considerations which are dependent on mechanisms and hardware of the molding machine it is used with.

SUMMARY

A proposed solution according to embodiments herein for improving insertion of meltable amorphous alloy material into a system to form molded objects or parts of bulk amorphous alloys.

One aspect of this disclosure provides an apparatus for loading one or more alloy ingots comprising a holder configured to hold a plurality of the alloy ingots and dispense one or more of the alloy ingots into a melt zone of a molding machine through an opening in a mold of the molding machine.

Another aspect provides a method for forming a bulk amorphous alloy containing part using a molding machine comprising a melt zone and a mold, including: loading one or more alloy ingots from a holder into the melt zone of the molding machine through an opening in the mold of the molding machine; melting the one or more alloy ingots in the melt zone to form a molten alloy; and introducing the molten alloy into the mold to form the bulk amorphous alloy containing part.

Yet another aspect provides an injection molding system including: a melt zone configured to melt meltable material; a mold configured to receive molten material from the melt zone for molding into a part, and an apparatus for loading the meltable material into the melt zone through an opening in the mold.

Other features and advantages of the present disclosure will become apparent from the following detailed description, the accompanying drawings, and the appended claims.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±0.5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
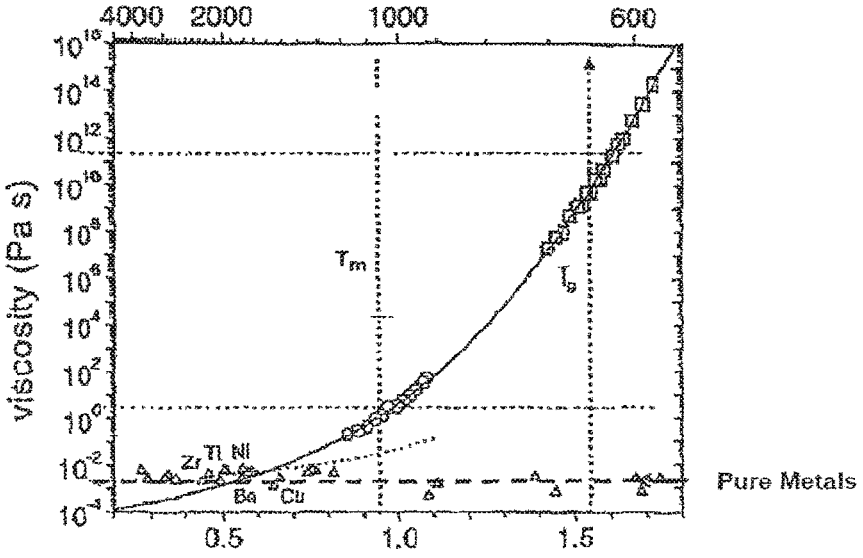
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
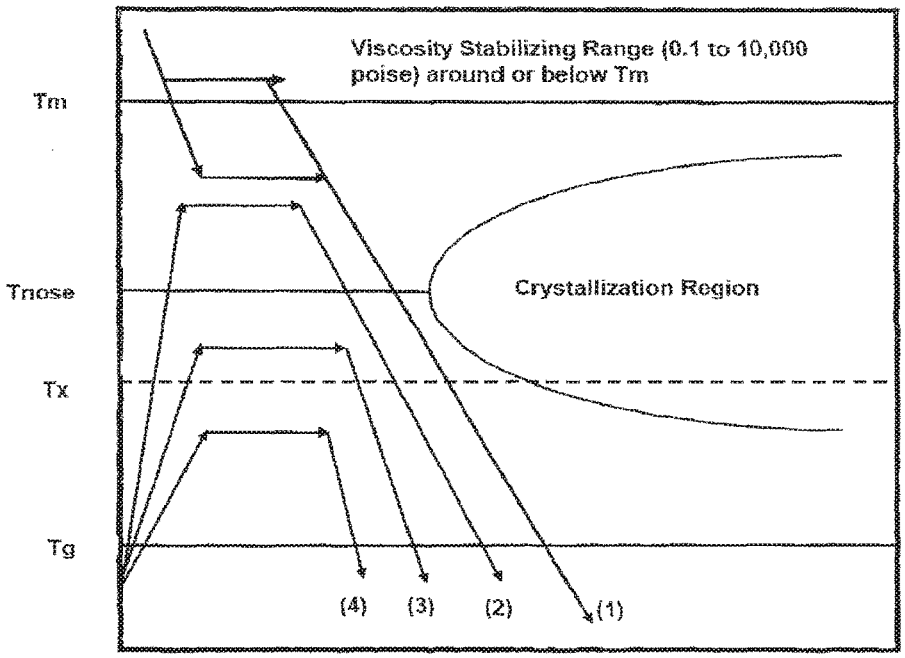
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2. Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Ph, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, scaborgium, bohrium, hassium, meitnerium, ununnilium, ununumium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous, this is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

TABLE 1

Exemplary amorphous alloy compositions

| Alloy | Atm % | Atm % | Atm % | Atm % | Atm % | Atm % |
|---|---|---|---|---|---|---|
| 1 | Zr<br>41.20% | Ti<br>13.80% | Cu<br>12.50% | Ni<br>10.00% | Be<br>22.50% | |
| 2 | Zr<br>44.00% | Ti<br>11.00% | Cu<br>10.00% | Ni<br>10.00% | Be<br>25.00% | |
| 3 | Zr<br>56.25% | Ti<br>11.25% | Cu<br>6.88% | Ni<br>5.63% | Nb<br>7.50% | Be<br>12.50% |
| 4 | Zr<br>64.75% | Ti<br>5.60% | Cu<br>14.90% | Ni<br>11.15% | Al<br>2.60% | Be<br>1.00% |
| 5 | Zr<br>52.50% | Ti<br>5.00% | Cu<br>17.90% | Ni<br>14.60% | Al<br>10.00% | |
| 6 | Zr<br>57.00% | Nb<br>5.00% | Cu<br>15.40% | Ni<br>12.60% | Al<br>10.00% | |
| 7 | Zr<br>50.75% | Cu<br>36.23% | Ni<br>4.03% | Al<br>9.00% | Sn<br>0.50% | |
| 8 | Zr<br>46.75% | Ti<br>8.25% | Cu<br>7.50% | Ni<br>10.00% | Be<br>27.50% | |

TABLE 1-continued

Exemplary amorphous alloy compositions

| Alloy | Atm % | Atm % | Atm % | Atm % | Atm % | Atm % |
|---|---|---|---|---|---|---|
| 9 | Zr<br>21.67% | Ti<br>43.33% | Ni<br>7.50% | Be<br>27.50% | | |
| 10 | Zr<br>35.00% | Ti<br>30.00% | Cu<br>7.50% | Be<br>27.50% | | |
| 11 | Zr<br>35.00% | Ti<br>30.00% | Co<br>6.00% | Be<br>29.00% | | |
| 12 | Au<br>49.00% | Ag<br>5.50% | Pd<br>2.30% | Cu<br>26.90% | Si<br>16.30% | |
| 13 | Au<br>50.90% | Ag<br>3.00% | Pd<br>2.30% | Cu<br>27.80% | Si<br>16.00% | |
| 14 | Pt<br>57.50% | Cu<br>14.70% | Ni<br>5.30% | P<br>22.50% | | |
| 15 | Zr<br>36.60% | Ti<br>31.40% | Nb<br>7.00% | Cu<br>5.90% | Be<br>19.10% | |
| 16 | Zr<br>38.30% | Ti<br>32.90% | Nb<br>7.30% | Cu<br>6.20% | Be<br>15.30% | |
| 17 | Zr<br>39.60% | Ti<br>33.90% | Nb<br>7.60% | Cu<br>6.40% | Be<br>12.50% | |
| 18 | Cu<br>47.00% | Ti<br>34.00% | Zr<br>11.00% | Ni<br>8.00% | | |
| 19 | Zr<br>55.00% | Co<br>25.00% | Al<br>20.00% | | | |

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid hulk solidifying alloy deforms locally which drastically lowers the required energy for cutting and forming. The case of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blu-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

The methods, techniques, and devices illustrated herein are not intended to be limited to the illustrated embodiments.

As disclosed herein, an apparatus or a system (or a device or a machine) is configured to perform melting of and injection molding of material(s) (such as amorphous alloys). The apparatus is configured to process such materials or alloys by melting at higher melting temperatures before injecting the molten material into a mold for molding. An apparatus (or device or mechanism) is provided to automatically insert meltable material into the system to be melted and molded. In an embodiment, parts of the apparatus can be positioned in-line with each other. In accordance with some embodiments, parts of the apparatus (or access thereto) are aligned on a horizontal axis.

Figure 3:
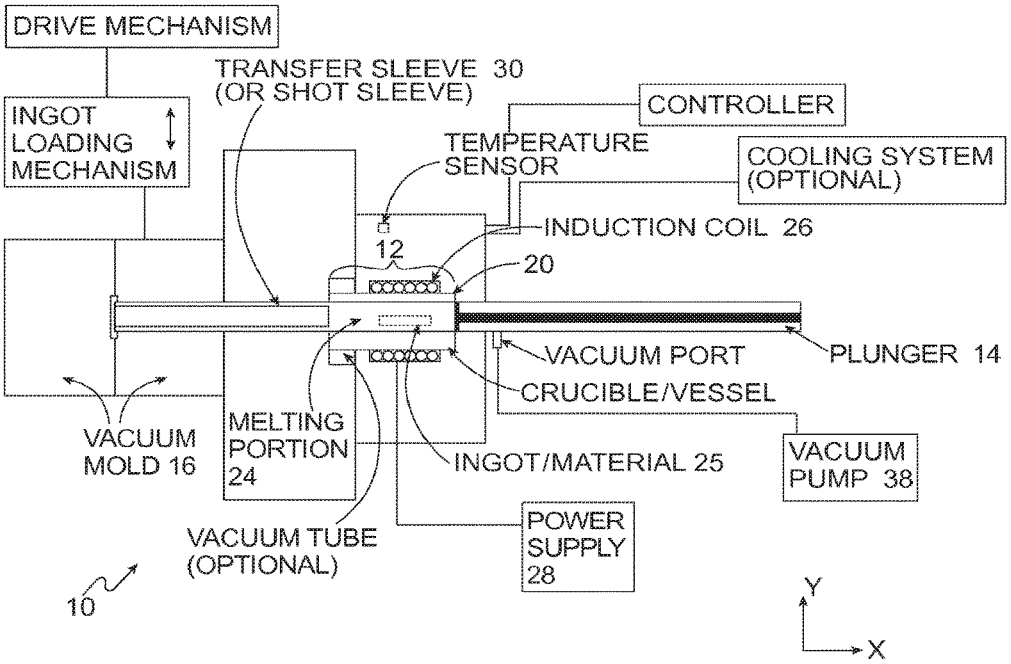
FIG. 3 illustrates an injection molding system with an apparatus for loading meltable material in accordance with an embodiment of the disclosure.
Figure 11:
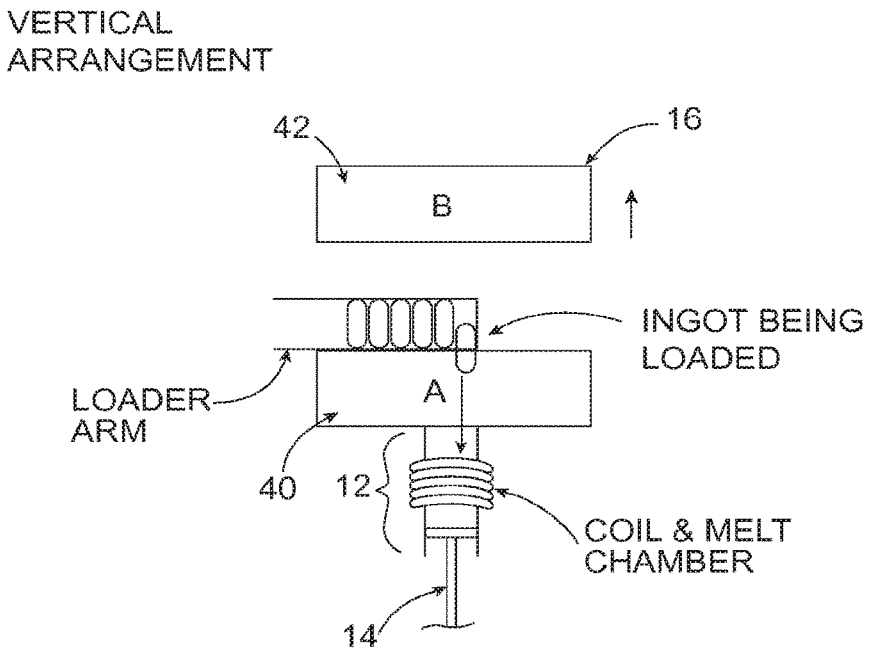
FIG. 11 illustrates a method of using an apparatus for loading material into the melt zone through the mold of an injection molding system its movement relative to the mold in accordance with another embodiment of the disclosure.

FIG. 3 illustrates a schematic diagram of such an exemplary system with an apparatus for loading meltable material in accordance with an embodiment of the disclosure. More specifically, FIG. 3 illustrates an injection molding apparatus or system 10. In accordance with an embodiment, injection molding system 10 has a melt zone 12 configured to melt meltable material received therein, and at least one plunger rod 14 configured to eject molten material from melt zone 12 and into a mold 16. In an embodiment, at least plunger rod 14 and melt zone 12 are provided in-line and on a horizontal axis (e.g., X axis), such that plunger rod 14 is moved in a horizontal direction (e.g., along the X-axis) substantially through melt zone 12 to move the molten material into mold 16. In another embodiment (e.g., parts of which are generally shown in FIG. 11), at least plunger rod 14 and melt zone 12 are provided in-line and on a vertical axis (e.g., Y axis), such that plunger rod 14 is moved in a vertical direction (e.g., along the Y-axis) substantially through melt zone 12 to move the molten material into mold 16. The mold can be positioned adjacent to the melt zone.

Generally, meltable material can be received in the melt zone in any number of forms. For example, the meltable material may be provided into melt zone 12 in the form of an ingot (solid state), a semi-solid state, a slurry that is preheated, powder, pellets, etc. Throughout this disclosure, ingots are described and designed to be inserted into the system 10 for automatic loading into the melt zone 12. That is, the loading apparatus/mechanism, described further below, is design to dispense one or more alloy ingots into the melt zone 12.

Melt zone 12 of system 10 includes a melting mechanism configured to receive meltable material and to hold the material as it is heated to a molten state. The melting mechanism may be in the form of a vessel 20, for example, that has a body for receiving meltable material and configured to melt the material therein. A vessel as used throughout this disclosure is a container made of a material employed for heating substances to high temperatures. For example, in an embodiment, the vessel may be a crucible, such as a boat style crucible, or a skull crucible. In an embodiment, vessel 20 is a cold hearth melting device that is configured to be utilized for meltable material(s) while under a vacuum (e.g., applied by a vacuum device 38 or pump). In one embodiment, the vessel is a temperature regulated vessel.

In the embodiments, the body of vessel 20 comprises a substantially U-shaped structure. For example, the body may comprise a base with side walls extending therefrom. However, this illustrated shape is not meant to be limiting. Vessel 20 can comprise any number of shapes or configurations. The body of the vessel has a length and can extend in a longitudinal direction (horizontally or vertically) in line with a longitudinal axis of the plunger 14, such that molten material can be removed therefrom using plunger 14. The material for heating or melting may be received in a melting portion 24 of the vessel. Melting portion 24 is configured to receive meltable material to be melted therein. For example, melting portion 24 has a surface for receiving material. As described below, vessel 20 receives material (e.g., in the form of one or more ingot(s)) in its melting portion 24 using an ingot loading apparatus 50.

In an embodiment, body and/or its melting portion 24 may comprise substantially rounded and/or smooth surfaces. For example, a surface of melting portion 24 may be formed in an arc shape. However, the shape and/or surfaces of the body are not meant to be limiting. The body may be an integral structure, or formed from separate parts that are joined or machined together. The body of vessel 20 may be formed from any number of materials (e.g., copper, silver), include one or more coatings, and/or configurations or designs. For example, one or more surfaces may have recesses or grooves therein.

The body of vessel 20 may be configured to receive the plunger rod therethrough to move the molten material. That is, in an embodiment, the melting mechanism is on the same axis as the plunger rod, and the body can be configured and/or sized to receive at least part of the plunger rod. Thus, plunger rod 14 can be configured to move molten material (after heating/melting) from the vessel by moving substantially through vessel 20, and into mold 16. Referencing the illustrated embodiment of system 10 in FIG. 3, for example, plunger rod 14 would move in a horizontal direction from the right towards the left, through vessel 20, moving and pushing the molten material towards and into mold 16. In an embodiment such as shown in FIG. 11, plunger rod 14 would move in a vertical direction upwardly, through vessel 20, moving and pushing the molten material towards and into mold 16.

To heat melt zone 12 and melt the meltable material (ingot(s)) received in vessel 20, injection system 10 also includes a heat source that is used to heat and melt the meltable material. At least melting portion 24 of the vessel, if not substantially the entire body itself, is configured to be heated such that the material received therein is melted. Heating is accomplished using, for example, an induction source 26 positioned within melt zone 12 that is configured to melt the meltable material. In an embodiment, induction source 26 is positioned adjacent vessel 20. For example, induction source 26 may be in the form of a coil positioned in a helical pattern substantially around a length of the vessel body. Accordingly, vessel 20 may be configured to inductively melt a meltable material (e.g., an inserted ingot) within melting portion 24 by supplying power to induction source/coil 26, using a power supply or source 28. Thus, the melt zone 12 can include an induction zone. Induction coil 26 is configured to heat up and melt any material that is contained by vessel 20 without melting and wetting vessel 20. Induction coil 26 emits radiofrequency (RF) waves towards vessel 20. As shown in FIG. 3, the body and coil 26 surrounding vessel 20 may be configured to be positioned in a horizontal direction along a horizontal axis (e.g., X axis), or, alternatively, in a vertical direction along a vertical axis as shown in FIG. 11.

In one embodiment, the vessel 20 is a temperature regulated vessel. Such a vessel may include one or more temperature regulating lines configured to flow a liquid (e.g., water, or other fluid) therein for regulating a temperature of the body of vessel 20 during melting of material received in the vessel (e.g., to force cool the vessel). Such a forced-cooled crucible can also be provided on the same axis as the plunger rod. The cooling line(s) can assist in preventing excessive heating and melting of the body of the vessel 20 itself. Cooling line(s) may be connected to a cooling system configured to induce flow of a liquid in the vessel. The cooling line(s) may include one or more inlets and outlets for the liquid or fluid to flow therethrough. The inlets and outlets of the cooling lines may be configured in any number of ways and are not meant to be limited. For example, cooling line(s) may be positioned relative to melting portion 24 such that material thereon is melted and the vessel temperature is regulated (i.e., heat is absorbed, and the vessel is cooled). The number, positioning and/or direction of the cooling line(s) should not be limited. The cooling liquid or fluid may be configured to flow through the cooling line(s) during melting of the meltable material, when induction source 26 is powered.

After the material is melted in the vessel 20, plunger 14 may be used to force the molten material from the vessel 20 and into a mold 16 for molding into an object, a part or a piece. In instances wherein the meltable material is an alloy, such as an amorphous alloy, the mold 16 is configured to form a molded hulk amorphous alloy object, part, or piece. Mold 16 has an inlet for receiving molten material therethrough. An output of the vessel 20 and an inlet of the mold 16 can be provided in-line (e.g., and on a horizontal axis) such that plunger rod 14 is moved through body of the vessel 20 to eject molten material and into the mold 16 via its inlet.

As previously noted, systems such as injection molding system 10 that are used to mold materials such as metals or alloys may implement a vacuum when forcing molten material into a mold or die cavity. Injection molding system 10 can further includes at least one vacuum source or pump 38 that is configured to apply vacuum pressure to at least melt zone 12 and mold 16. The vacuum pressure may be applied to at least the parts of the injection molding system 10 used to melt, move or transfer, and mold the material therein. For example, the vessel 20, a transfer sleeve 30, and plunger rod 14 may all be under vacuum pressure and/or enclosed in a vacuum chamber during the melting and molding process.

Figure 4:
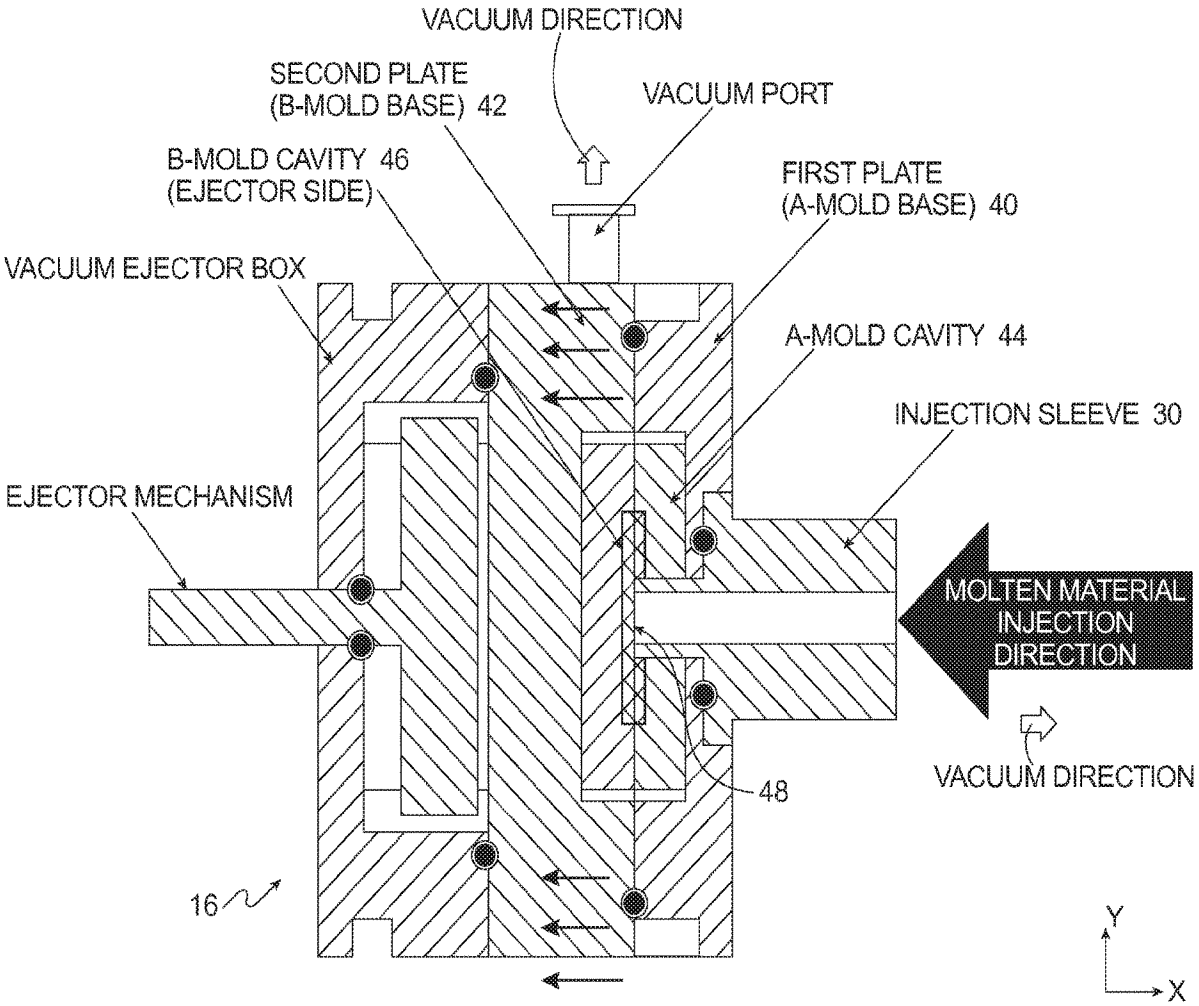
FIG. 4 illustrates a cross sectional view of a mold assembly with first and second plates for use with an injection molding system such as shown in FIG. 3.

In an embodiment, mold 16 is a vacuum mold that is an enclosed structure configured to regulate vacuum pressure therein when molding materials. For example, in an embodiment, vacuum mold 16 comprises a first plate 40 (also referred to as an "A" mold or "A" plate), a second plate 42 (also referred to as a "B" mold or "B" plate) positioned adjacently (respectively) with respect to each other. FIG. 4 illustrates a cross sectional view of an exemplary mold assembly 16 with first and second plates 40 and 42 for use with an injection molding system 10 such as shown in FIG. 3, in accordance with one embodiment. The first plate 40 and second plate 42 generally each have a mold cavity. 44 and 46, respectively, associated therewith for molding melted material therebetween. The cavities 44 and 46 are configured to mold molten material received therebetween via pushing material from melt zone 12 and through transfer sleeve 30. The mold cavities 44 and 46 may include a part cavity for forming and molding a part therein.

Generally, the first plate ("A" plate) may be connected to transfer sleeve 30 (see FIG. 4). In accordance with an embodiment, during a cycle, plunger rod 14 is configured to move molten material from vessel 20, through transfer sleeve 30, and into mold 16. Transfer sleeve 30 (sometimes referred to as a shot sleeve, a cold sleeve or an injection sleeve in the art and herein) may be provided between melt zone 12 and mold 16. Transfer sleeve 30 has an opening that is configured to receive and allow transfer of the molten material therethrough and into mold 16 (using plunger 14). In the embodiment shown in FIG. 3, its opening is provided in a horizontal direction along the horizontal axis (e.g., X axis). It can also be provided on a vertical axis (see FIG. 11). The transfer sleeve need not be a cold chamber. In an embodiment, at least plunger rod 14, vessel 20 (e.g., its receiving or melting portion), and opening of the transfer sleeve 30 are provided in-line and on the same axis, such that plunger rod 14 can be moved in a direction along the axis, through vessel 20 in order to move the molten material into (and subsequently through) the opening of transfer sleeve 30.

Molten material is pushed (e.g., in a horizontal direction) through transfer sleeve 30 and into the mold cavity(ies) 44 and 46 via the inlet (e.g., in a first plate) and between the first and second plates. During molding of the material, the at least first and second plates 40 and 42 are configured to substantially eliminate exposure of the material (e.g., amorphous alloy) therebetween to at least oxygen and nitrogen. Specifically, a vacuum is applied such that atmospheric air is substantially eliminated from within the plates and their cavities. A vacuum is applied to an inside of vacuum mold 16 using at least one vacuum source 38 that is connected via vacuum lines. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr.

The plates 40 and 42 are configured to be moved with respect to each other to either separate the plates (to insert meltable material and/or eject a molded part) or connect the plates for molding. In a embodiment, the second "B" plate 42 moves away from the first "A" plate 40 (as shown by representative arrows in FIG. 4, for example). The plates 40 and 42 can be moved with respect to each other in a horizontal or vertical direction. For example, after the molding process, the molded part is removed from the mold cavity(ies) 44 and 46. An ejector mechanism (not shown) is configured to eject molded (amorphous alloy) material (or the molded part) from the mold cavity between the first and second plates of mold 16, be ejection mechanism is associated with or connected to an actuation mechanism (not shown) that is configured to be actuated in order to eject the molded material or part (e.g., after first and second parts and are moved horizontally and relatively away from each other, after vacuum pressure between at least the plates is released).

However, any number or types of mold assemblies may be employed in the apparatus 10. For example, any number of plates may be provided between and/or adjacent the first and second plates to form the mold. Molds known as "A" series, "B" series, and/or "X" series molds, for example, may be implemented in injection molding system/apparatus 10.

As previously mentioned, system 10 also comprises an ingot loading mechanism or apparatus 50 for loading meltable material into the melt zone 12 through an opening in the mold 16. Ingot loading apparatus 50 can be added or retrofitted to an existing injection molding system and/or incorporated therewith. It can also be retrofitted to existing molds and mold bases. Ingot loading apparatus 50 may be in the form of a robot or other device. Ingot loading apparatus 50 is designed to be an automated mechanism for cyclic reloading of an injection molding system. It improves the overall injection molding process for the bulk metallic process. e.g., providing shorter cycle times (from insertion of material to ejection of a molded product), reduced complexity, greater economy, etc., and can be used with an inline system.

Figure 5:
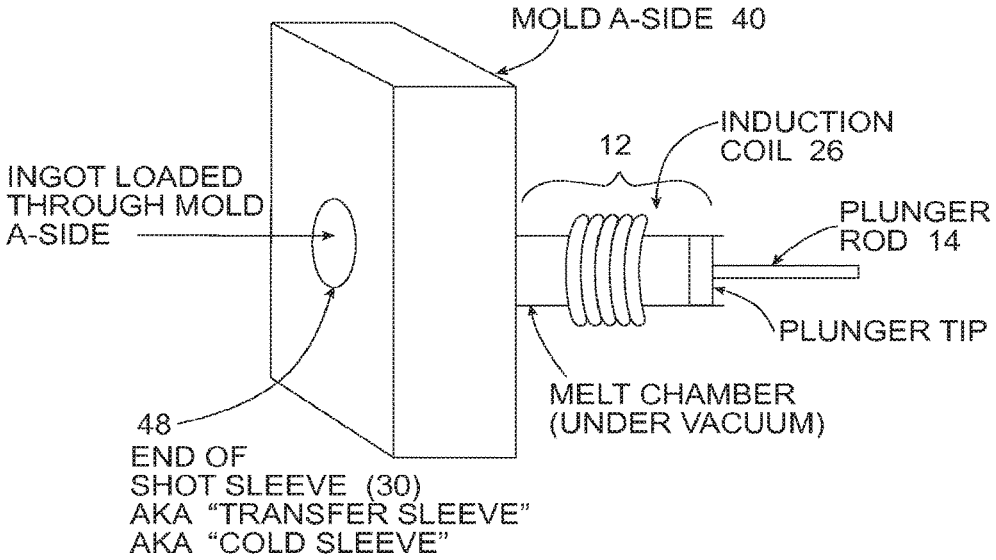
FIG. 5 illustrates a perspective view of a part (first plate) of the mold assembly and melt zone of the injection molding system shown in FIG. 3.

For explanatory purposes, the disclosed loading apparatus 50 and parts of the injection molding system 10 are described with reference to the horizontal axis (e.g., X-axis). However, as noted later, any of the devices may be positioned on a vertical axis (see FIG. 11). In this disclosure, the material to be melted is loaded via a pathway through one or more parts of the system 10. For example, in addition to ejecting a molded part, plates 40 and 42 can be moved relative to one another in order to insert meltable material (e.g., ingot) into the melt zone 12. FIG. 5 shows a perspective view of first "A" plate 40 of the mold assembly 16 and melt zone 12. As can be seen by the view in FIG. 4, at least a part of the injection/transfer sleeve 30 extends through first plate 40 such that melted material can be pushed by plunger and out of an output part at an end 48 of the sleeve 30 and into the mold 16 (between cavities 44 and 46). This end 48 can also be used to dispense meltable material into the melt zone 12. More specifically, in accordance with an embodiment, the material (e.g., ingot(s)) may be inserted in a horizontal direction from the mold side of the injection system 10, through end 48 of first plate 40 of mold 16, through transfer sleeve 30 (if present), and into melt zone 12 (e.g., vessel 20), such that is can be melted and molded.

Figure 6:
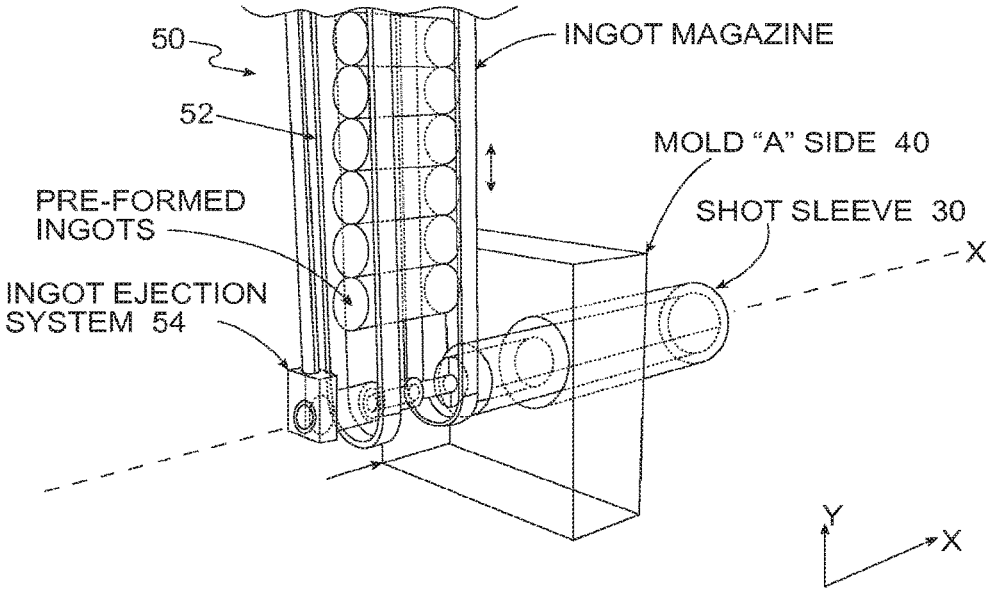
FIG. 6 illustrates a perspective view of an apparatus for loading material into the melt zone through the mold of an injection molding system in a first position in accordance with an embodiment of the disclosure.

FIG. 6 illustrates one example of an ingot loading apparatus 50. Ingot loading apparatus 50 comprises a holder 52 or feed mechanism that holds a plurality of ingots and is configured to dispense one or more of the alloy ingots into the melt zone 12. The ingots may be in the form of a cylinder or other extruded geometry solid state pre-form. In an embodiment, the holder 52 comprises an armature-mounted magazine for holding alloy ingots. For example, the ingots can be stacked parallel to each other, on top of each other, or adjacent to each other.

Ingot loading apparatus 50 comprises an actuation or ejection mechanism 54 associated therewith that is configured to dispense one or more of the alloy ingots from the holder 52. The actuation or ejection mechanism 54 may comprise any number of devices for moving an ingot. In an embodiment, a mechanical device is used to dispense and move an ingot into the melt zone 12. For example, an armature device (like a plunger) may be used to move the ingot from the holder 52, through mold 16 and into melt zone 12. The device can be telescopic, or can use any other mechanism which allows the device to meet the limited span of the open mold geometry while being able to extend far enough (e.g., in the X direction) so as to deliver an ingot(s) into the melt zone. In an embodiment, the ejection mechanism 54 comprises a telescoping pneumatic cylinder.

In another embodiment, air (air pressure) itself can be used as an ejection mechanism for moving an ingot. For example, a hose may be positioned such that its output it at a location for dispensing an ingot, and a device may be configured to dispense and apply a burst of air (e.g., compressed air) to force the ingot into the sleeve 30 and into melt zone 12. In some cases, the pressure may be configured such that each ingot is positioned near or up against the plunger tip of plunger 14 (provided adjacent to melt zone 12). In an embodiment, the tip of plunger 14 may act as a stop mechanism for assisting in positioning an ingot in melt zone 12. For example, the plunger 14 may be positioned adjacent the melt zone 12 (e.g., adjacent vessel 20) such that if a force used to insert or push an ingot in through mold 16 and into melt zone 12 results in moving the ingot a greater speed or distance, the tip of the plunger 14 can stop movement of the ingot in the X direction, so that it is positioned in melt zone 12.

In yet another embodiment, a spring-loaded hammer or other trip-action actuated device could be used to kick (rapidly accelerate) the ingot out of the holder and through the mold 16 and into melt zone 12, where it could come to rest against the plunger 14.

In an embodiment, the ejection mechanism 54 is configured to be completely automated such that it can be reloaded before the beginning of each melting and molding process. In one embodiment, the actuation or movement of plates 40, 42 of the mold 16 can be used to start and/or drive the positioning of the ingot loading apparatus 50 into its first or second position. In an embodiment, the apparatus has its own actuators, e.g., driven by a stepper motor, belt, piston, et al.

To move the ingot loading apparatus 50 such that it can dispense one or more ingots, holder 52 comprises a drive mechanism associated therewith. The drive mechanism (shown schematically in FIG. 3) is configured to selectively move at least part of holder 52 between a first position in line with the opening in the mold (at end 48) to dispense one or more of the alloy ingots and a second position away from the opening in the mold (away from end 48). For example, in an embodiment, holder 52 is configured to move (or be moved by drive mechanism) in a perpendicular direction with respect to an axis along a center of the opening in the mold between the first position and the second position. When the melt zone 12 is positioned along a horizontal axis, for example, the one or more of the alloy ingots can be dispensed into the melt zone 12 in a horizontal direction (e.g., along or parallel to the direction of the X-axis) through mold 16. In an embodiment, when moving away from dispensing to its second position (e.g., so that the process can begin), the holder is configured to move in a vertical direction (e.g., upwardly and/or downwardly) with respect to the mold. In the second position, the apparatus 50 remains in a ready position, such that when the next ingot(s) is to be dispensed, it can be moved to its first position, in line and ready for insert the ingot(s) through the mold 16.

Although holder of ingot loading apparatus 50 may be configured to move generally perpendicularly with respect to mold 16, it should also be understood that apparatus 50 and/or holder 52 may be configured to additionally move in a parallel direction and/or angled direction with respect to mold 16, so that it can be properly aligned for dispensing. For example, it should be understood that horizontal and/or vertical adjustment can be used such that a holder 52 is aligned with and close to (or farther away from) opening such that ingot can be smoothly inserted through the mold 16.

The holder 52 can include other parts or devices as well. For example, in an embodiment, each ingot is loaded such that it is aligned with the opening of the first "A" side 40 of the mold 16 (i.e., the opening in the end 48 of the transfer sleeve 30) so that it can be dispensed and moved in the horizontal direction. The aligning of each ingot may be employed, for example, via gravity. When the ingots are stacked in a magazine-like fashion, for example, each ingot may be configured to drop via gravity into a position for dispensing (e.g., substantially aligned with a pathway through mold). Other devices, such as chutes or paths may be used to assist in movement of ingot into mold 16. Some combination of methods/devices is also possible.

It should be noted that the herein mentioned parts of ingot loading apparatus 50 may also be used with a vertical system, which is shown in FIG. 11. For example, in accordance with an embodiment, an injection molding system may comprise a melt zone that is positioned along a vertical axis such that the one or more of the alloy ingots is dispensed into the melt zone in a vertical direction. As shown in FIG. 11, the holder is configured to move in a horizontal direction with respect to the mold. In this way, the actuation or ejection mechanism may be actuated such that one or more ingots is dispensed through an end of the transfer sleeve 30 and into the melt zone/vessel. In another embodiment, gravity can be used for dispensing an ingot into therein. For example, the ingot can be unloaded and dispensed down into the transfer sleeve 30 by means of gravitational forces, being stopped in the melt zone 12 by the plunger tip.

As previously noted, the configuration of ingot loading apparatus 50 and its holder 52 in FIG. 6 is not meant to be limited to an armature and a magazine of ingots. Other embodiments for apparatus 50 are also envisioned. For example, in one embodiment, apparatus 50 comprises a conveyor feed system, so that one or more ingots could be provided on an endless conveyor (e.g., a belt or a chain). Each ingot could be provided in a slot, opening, or area that allows each ingot to be separated and spaced along the conveyor. Temporary holding devices (such as metal forks) may be employed along the conveyor, for example. As the conveyor is moved the ingots are moved. At the dispensing location, an ingot can be dropped into a position that allows it to be moved through the mold 16 (e.g., aligned so that an ejection mechanism 54 can push it) or directly into the pathway therethrough.

In another embodiment, the ingots do not need to be stacked or aligned. For example, in an embodiment, ingots are provided in a holding vessel that is configured to dispense each ingot (e.g., down a slide or chute) for loading into the injection molding system 10. Again, an ingot can be dropped into a position that allows it to be moved through the mold 16 (e.g., aligned so that an ejection mechanism 54 can push it) or directly into the pathway therethrough.

Other designs of ingot loading apparatus 50 may include devices such as a telescoping piston or a stiff backed chain as part of its ejection mechanism 54, that are designed so as to accommodate the space between the mold sides but also push an ingot into melt zone 12. Such devices as ejection mechanism 54 can be designed to be pushed by a lever mechanism in order to push an ingot into place. More specifically, such devices can be pushed to extend into the pathway of mold 16 and sleeve 30 to mechanically push the ingot into place, and retract after insertion of the ingot. In an embodiment, the ejection mechanism 54 may be configured to turn at an angle relative to the axis of mold opening and melt zone. For example, a chain can be positioned to turn at least once at 90 degrees relative to the opening, and can still be used to push ingot(s) into melt zone 12.

In any of the herein described embodiments, the device for introducing the ingot into the melt zone 12 of is designed to be compact enough to fit within the area of the opened mold (i.e., a space between the first and second sides 40 and 42 when moved relatively away from each other).

Moreover, it should be noted that it is envisioned that in some cases, devices from the injection molding system 10 may also be used to assist in the loading process of the one or more ingots. For example, should system 10 comprise a second plunger, e.g., coming in from a side of the mold 16 in an opposite direction to that of plunger 14, the second plunger could be used as the ejection mechanism (or injection mechanism) for pushing ingot(s) into the melt zone 12.

Of course, it should also be noted that the movement and positions of the ingot loading apparatus 50 are also not limited. Although the apparatus is described as moving vertically from above the injection molding system, it is also envisioned that, in embodiments, ingot loading apparatus may be configured to move into alignment with the opening in mold 16 via moving vertically in a downward direction (from above), moving horizontally (from either side), or even moving vertically in an upward direction (from below). It can also swing into place and/or move in a different direction relative to mold 16.

FIGS. 7-10 illustrate a method of using ingot loading apparatus 50 and its general movement relative to mold 16 and melt zone 12 that is horizontally positioned in an injection molding system, such as system 10. Generally, the method entails loading one or more alloy ingots from holder 52 of apparatus 50 into the melt zone 12 of the molding machine 10 through an opening in its mold 16. The machine can then be used to melt the one or more alloy ingots in its melt zone 12 to form a molten alloy. In some instances, the mold 16 may be closed (e.g., first and second plates 40 and 42 are moved relative to each other in a closed position) and a vacuum (using vacuum pump 38) applied to at least parts of the system before melting. Thereafter, the molten alloy (from melting the ingot) is introduced into the mold 16 to form a part.

Figure 7:
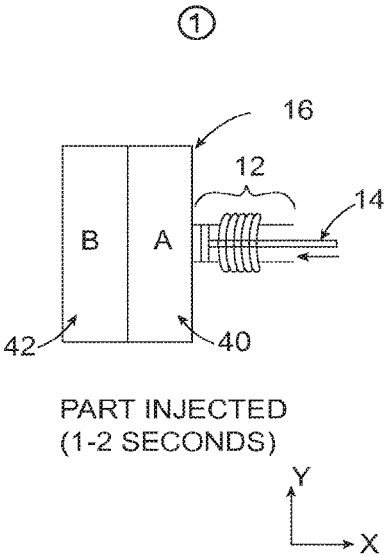
FIGS. 7-10 illustrate a method of using the apparatus of FIG. 6 its movement relative to the mold in accordance with an embodiment.
Figure 8:
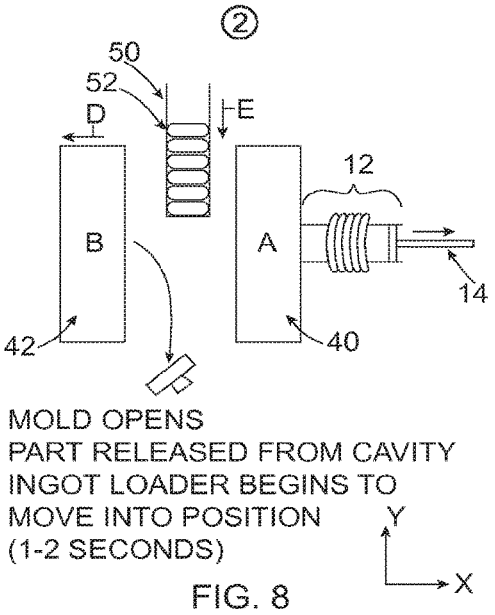
Figure 9:
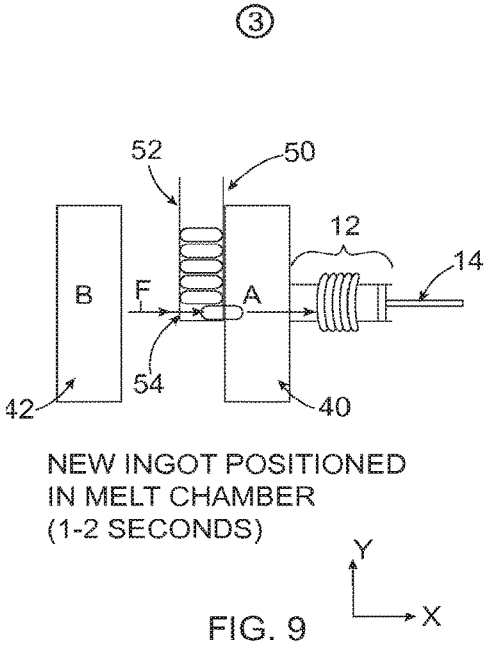
Figure 10:
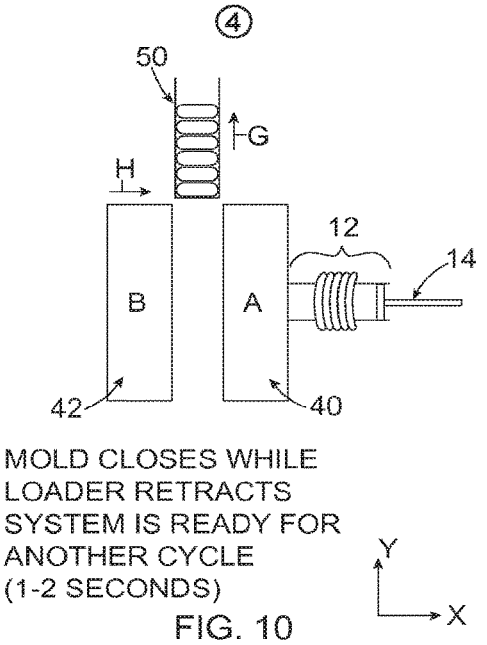

More specifically, the injection molding system 10 and ingot loading apparatus 50 may be operated in the following manner: Meltable material (e.g., amorphous alloy or BMG) in the form of ingots is loaded into a holder 52 of the ingot loading apparatus 50. Apparatus 50 is in its second position away from the opening in the mold during molding of parts, such as shown in FIG. 7. Specifically, FIG. 7 shows how the plates 40 and 42 of mold 16 are sealed (via a vacuum) as a part is formed through injection of molten material into its cavities (apparatus 50 not shown). Such an injection process may take approximately 1-3 seconds, for example. Once a part is molded (e.g., approximately 10 to 15 seconds), and before a new melting and molding process begins, second plate 42 moves relative to first plate 40 in a horizontal direction away from first plate (see arrow D), and the molded part is ejected (e.g., from second plate 42). Ingot loading apparatus 50 is then moved (e.g., using its drive mechanism 52) from its second position, down in between first and second plates 40 and 42 and into its first position (see arrow E) such that its dispenser/ejection mechanism 54 is in line with the opening in mold 16 (end 48 of transfer sleeve 30), as shown in FIG. 9. Alignment of the apparatus 50 may include both vertical and horizontal movement. Such a process may take approximately 1-3 seconds, for example. The ejector mechanism 54 then dispenses one or more ingots through the opening in the mold 16 and sleeve 30 (see arrow F) such that it/they are inserted into and received in the melt zone 12, into the vessel 20 (surrounded by the induction coil 26). In some instances, the injection molding machine "nozzle" stroke or plunger 14 can be used to align the material, as needed, into the melting portion of the vessel 20. Then, as shown in FIG. 10, ingot loading apparatus 50 is moved vertically upwardly back into its second position away from the opening of the mold 16 (see arrow G). As apparatus 50 moves, second plate 42 is moved relative to first plate 40 to close mold 16 (see arrow H). The system is then reading for another melting and molding cycle to form a part.

The system can be placed under vacuum using vacuum source 38. The ingot(s) of material is/are then heated through the induction process by heating induction coil 26. Once the temperature is achieved and maintained to melt the meltable material, the heating using induction coil 26 can be stopped and the machine will then begin the injection of the molten material from vessel 20, through transfer sleeve 30, and into vacuum mold 16 by moving plunger 14 in a horizontal direction (from right to left) along the horizontal axis. The mold 16 is configured to receive molten material through an inlet (from end 48 of sleeve 30) and configured to mold the molten material under vacuum. That is, the molten material is injected into a cavity between the at least first and second plates to mold the part in the mold 16. Once the mold cavity has begun to fill, vacuum pressure (via the vacuum lines and vacuum source 38) can be held at a given pressure to "pack" the molten material into the remaining void regions within the mold cavity and mold the material. After the molding process (e.g., approximately 10 to 15 seconds), the vacuum pressure applied to the mold 16 is released. Mold 16 is then opened to relieve pressure, to expose the part to the atmosphere for ejection, and for movement of the ingot loading apparatus 50 into alignment and for dispensing of one or more ingots into melt zone 12. Thereafter, the process can begin again.

Accordingly, the herein disclosed embodiments illustrate an exemplary injection system that has an ingot loading apparatus associated therewith for providing automatic loading and dispensing of ingots into the melt zone so that parts can be cyclically formed using a mold. For example, the loading apparatus can hold ingots of amorphous alloy and the system can be used to form a bulk amorphous alloy containing part.

The herein described ingot loading apparatus provides several benefits and advantages, including, but not limited to: simplifying the design of the injection molding machine/system by eliminating the need for an ingot loading port at any position along the bore of the device (as seen in conventional systems). This in turn decreases the number of welds, o-rings, collars, caps, and other potential leak-up points for gases. As the process is performed under vacuum, by minimizing points for potential problems such as leaks, this further eliminates possibly of contaminants from the air reaching the molten material.

It also minimizes the cost of the system because it is less complex. Removing the ingot loading port also reduces the size and overall volume of the chamber that needs to be evacuated in the system (e.g., chamber in melt zone, transfer sleeve, and mold cavities). In turn, the length of the injection cycle is also then reduced, because it is quicker to vacuum seal (evacuate) a smaller chamber, which thereby reduces and/or minimizes the cycle time.

The ingot loading apparatus also reduces an overall length of the plunger rod necessary for a given machine by eliminating any need for the plunger rod to travel outside the induction heating coil region for ingot loading purposes. Typically, the plunger rod is formed at a length that allows it to back up away from melt zone with its the plunger tip outside of the melt zone/coil so that an ingot can be loaded into the melt zone/vessel. The length at which the plunger is formed then is quite long, as is the machine itself. However, because the ingot loading port/area is eliminated, the plunger rod does not need to withdraw as far, and thus its length can be reduced. Moreover, some length of the system itself can be reduced, which is also beneficial with regards to space. Higher vacuum pressures can also be applied to system 10 because typically an entire length of the plunger 14 needs to also be pressurized during the melting and molding process—thus, the volume for applying the vacuum in conventional systems is larger. However, with at least the reduction in the length of the plunger 14, a better vacuum seal is applied.

Figure 12:
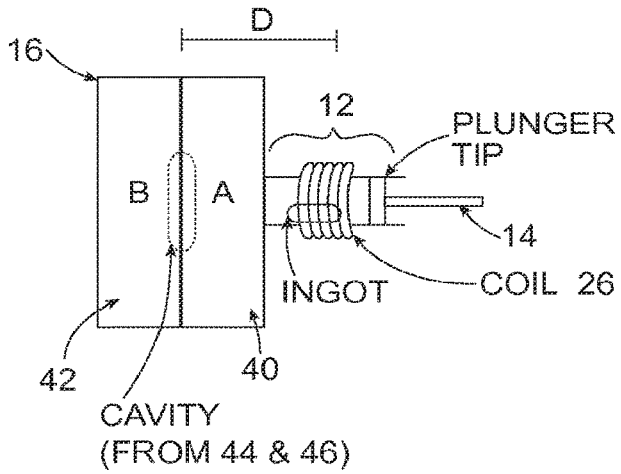
FIG. 12 illustrates a view of the mold and melt zone of an injection molding system.

Additionally, ingot loading apparatus 50 can minimize a distance between the area of performing the melting (on the vessel 20 in melt zone 12) and the cavity(ies) for forming the molded part (in the mold 16). For example, as shown by the view of the mold and melt zone in FIG. 12, the cavity and melt zone are positioned at a distance D. This distance D can be reduced when using an ingot loading apparatus such as apparatus 50 (e.g., by reducing length of transfer sleeve 30 and/or vessel 20). This is beneficial because by reducing the distance D, the length at which molten material is moved and/or travels between the melting point and injection into the mold cavity is reduced. Subsequently, the amount of time that elapses between the time that the melting completes and the point at which the part is cast is reduced. Reducing the amount of time between the melt and mold is beneficial for molten materials such as amorphous alloys because of their amorphous properties. By reducing the amount of time in which such molten materials are quenched, better quality molded amorphous parts are obtained.

In accordance with yet another embodiment, it should be understood that the location for aligning and dispensing ingots should not be limited. For example, although the Figures show the ingot loading apparatus 50 aligning with first side 40 of mold so that ingots can be moved through end 48 of transfer sleeve 30 and into melt zone 12, it should be understood that ingot loading apparatus 50 may also be configured to align with an opening in second side 42 of mold 16. That is, second side 42 of mold may have an opening therethrough that allows for insertion of material into the melt zone 12. Accordingly, it should be understood that ingot loading apparatus 50 may be configured to dispense one or more of the alloy ingots from either side of the mold, depending on the configuration of the molding/casting machine it is used with.

Ingot loading apparatus 50 may further comprise a control mechanism, actuators, and/or sensors associated therewith to assist in automatic control (alignment, dispensement) of the device. For example, when the injection molding system 10 gets ready to open up the mold, a signal can be sent to the apparatus 50 to move to its first position (e.g., from the system 10, via a sensor). Accordingly, the parameters of ingot loading apparatus 50 can be based on the injection molding system 10 it is associated with. For example, based on parameters of the first and second plates 40 and 42 of mold 16 move relatively to each other, e.g., speed (for moving—opening and closing), time (e.g., how long mold 16 waits before opening and how long it stays open), etc.), parameters (e.g., speed (for moving between first and second positions)), time (e.g., how long it waits before dispensing and/or how fast it dispenses), etc.) of ingot loading mechanism can also be set. Sensors (such as optical gates, lasers (IR), or mechanical switches) can be used to determine and/or verify that it is safe for the ingot loading apparatus 50 to extend into the mold 16 (e.g., between the two halves of the mold), and when to move out of the way. An interface box to translate signals from injection molding system 10 to ingot loading apparatus 50 can be provided and control and apply motive force for the different parts of ingot loading apparatus 50.

Further, one or more sensors can be used to verify mechanical alignment of an output of ingot loading apparatus 50 with an opening in mold 16. For example, a sensor (e.g., infrared) or detector could be provided at an end of the holder 52 near the ejection mechanism 54 to determine alignment with mold 16. One or more sensors can also be used as a safety measure, e.g., to prevent damage and/or collision of the devices.

Also, any software or firmware can be used with ingot loading apparatus 50.

In addition to the features described herein, it should be understood that the dimensions, configurations, and materials mentioned herein should not be limited. Different materials and/or configurations may be used to form different parts.

Although not described in great detail, the disclosed injection system may include additional parts including, but not limited to, one or more sensors, flow meters, etc. (e.g., to monitor temperature, cooling water flow, etc.), and/or one or more controllers. Also, seals can be provided with or adjacent any of number of the parts to assist during melting and formation of a part of the molten material when under vacuum pressure, by substantially limiting or eliminating substantial exposure or leakage of air. For example, the seals may be in the form of an O-ring. A seal is defined as a device that can be made of any material and that stops movement of material (such as air) between parts which it seals. The injection system may implement an automatic or semi-automatic process for not only inserting meltable material (ingots) therein using the ingot loading apparatus/mechanism, but also for the process of applying a vacuum, heating, injecting, and molding the material to form a part.

The material to be molded (and/or melted) using any of the embodiments of the injection system as disclosed herein may include any number of materials and should not be limited. In one embodiment, the material to be molded is an amorphous alloy, as described in detail above.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will be appreciated that many of the above-disclosed and other features and functions, or alternatives thereof, may be desirably combined into many other different systems/devices or applications. Various presently unforeseen or unanticipated alternatives, modifications, variations, or improvements therein may be subsequently made by those skilled in the art which are also intended to be encompassed by the following claims.

The invention claimed is:

1. An apparatus for loading one or more alloy ingots comprising a holder configured to hold a plurality of the alloy ingots and dispense one or more of the alloy ingots into a melt zone of a molding machine through an opening in a mold of the molding machine;

wherein the holder comprises a drive mechanism associated therewith that is configured to selectively move at least part of the holder between a first position in line with the opening in the mold to dispense the one or more of the alloy ingots and a second position away from the opening in the mold.

2. The apparatus according to claim 1, wherein the holder is configured to move in a perpendicular direction with respect to an axis along a center of the opening in the mold between the first position and the second position.

3. The apparatus according to claim 2, wherein the melt zone is positioned along a horizontal axis such that the one or more of the alloy ingots is dispensed into the melt zone in a horizontal direction, and wherein the holder is configured to move in a vertical direction with respect to the mold.

4. The apparatus according to claim 2, wherein the melt zone is positioned along a vertical axis such that the one or more of the alloy ingots is dispensed into the melt zone in a vertical direction, and wherein the holder is configured to move in a horizontal direction with respect to the mold.

5. The apparatus according to claim 1, wherein the melt zone is positioned along a horizontal axis and wherein the movement of the one or more of the alloy ingots into the melt zone is in a horizontal direction through the opening in the mold.

6. The apparatus according to claim 5, further comprising an actuation mechanism associated therewith that is configured to dispense said one or more of the alloy ingots in the horizontal direction.

7. The apparatus according to claim 1, wherein the one or more alloy ingots are made of amorphous alloy material.

8. A method for forming a bulk amorphous alloy containing part using a molding machine comprising a melt zone and a mold, comprising:

loading one or more alloy ingots from a holder into the melt zone of the molding machine through an opening in the mold of the molding machine;

melting the one or more alloy ingots in the melt zone to form a molten alloy; and introducing the molten alloy into the mold to form the bulk amorphous alloy containing part;

wherein the holder is configured to hold a plurality of the alloy ingots and dispense the one or more of the alloy ingots into the melt zone of the molding machine through the opening in the mold of the molding machine; and wherein the holder comprises a drive mechanism associated therewith that is configured to selectively move at least part of the holder between a first position in line with the opening in the mold to dispense the one or more of the alloy ingots and a second position away from the opening in the mold.

9. The method according to claim 8, wherein the method further comprises:

moving the holder into the first position to load the one or more alloy ingots into the melt zone.

10. The method according to claim 9, wherein the holder is configured to move in a perpendicular direction with respect to an axis along a center of the opening in the mold between the first position and the second position, and wherein the moving of the holder into the first position comprises moving the holder in a perpendicular direction with respect to the axis along the center of the opening.

11. The method according to claim 10, wherein the moving of the holder comprises moving the holder in a vertical direction with respect to the mold.

12. The method according to claim 10, wherein the moving of the holder comprises moving the holder in a horizontal direction with respect to the mold.

13. The method according to claim 8, wherein the dispensing of the one or more alloy ingots from the holder into the melt zone is in a horizontal direction through the opening in the mold.

14. The method according to claim 8, wherein the molding machine further comprises an induction source, and wherein the method further comprises melting the one or more alloy ingots in the melt zone using the induction source.

15. The method according to claim 8, wherein the molding machine comprises at least one vacuum source configured to apply vacuum pressure to at least the melt zone and mold, and wherein the method further comprises applying a vacuum on the melt zone and the mold such that the melting and the molding is performed under vacuum.

16. An injection molding system comprising:

a melt zone configured to melt meltable material a mold configured to receive molten material from the melt zone for molding into a part, and an apparatus for loading the meltable material into the melt zone through an opening in the mold, wherein the apparatus comprises a drive mechanism associated therewith that is configured to selectively move the apparatus between a first position in line with the opening in the mold to load the meltable material and a second position away from the opening in the mold.

17. The system according to claim 16, wherein the apparatus comprises a holder configured to hold a plurality of alloy ingots and dispense one or more of the alloy ingots into the melt zone.

18. The system according to claim 16, wherein the apparatus is configured to move in a perpendicular direction with respect to an axis along a center of the opening in the mold between the first position and the second position.

19. The system according to claim 18, wherein the melt zone is positioned along a horizontal axis such that the meltable material is loaded into the melt zone in a horizontal direction, and wherein the apparatus is configured to move in a vertical direction with respect to the mold.

20. The system according to claim 18, wherein the melt zone is positioned along a vertical axis such that the meltable material is loaded into the melt zone in a vertical direction, and wherein the apparatus is configured to move in a horizontal direction with respect to the mold.

21. The system according to claim 16, wherein the melt zone is positioned along a horizontal axis and wherein the movement of the meltable material into the melt zone is in a horizontal direction through the opening in the mold.

22. The system according to claim 21, wherein the apparatus comprises an actuation mechanism associated therewith that is configured to load the meltable material in the horizontal direction.

23. The system according to claim 16, further comprising an induction source positioned within the melt zone that is configured to melt the meltable material.

24. The system according to claim 16, further comprising a transfer sleeve between the melt zone and the mold that is configured to receive the molten material therethrough.

25. The system according to claim 16, further comprising at least one vacuum source that is configured to apply vacuum pressure to at least the melt zone and the mold.

26. The system according to claim 16, wherein the meltable material is an alloy and wherein the mold is configured to form a molded bulk amorphous alloy object.

* * * * *